US006854512B2

(12) United States Patent
Lee et al.

(10) Patent No.: US 6,854,512 B2
(45) Date of Patent: Feb. 15, 2005

(54) HEAT EXCHANGER TUBE AND HEAT EXCHANGER USING THE SAME

(75) Inventors: Sangok Lee, Daejeon-si (KR); Kwangheon Oh, Daejeon-si (KR); Eunki Min, Daejeon-si (KR); Taeyoung Park, Daejeon-si (KR)

(73) Assignee: Halla Climate Control Corporation, Daejeon-Si (KR)

( * ) Notice: Subject to any disclaimer, the term of this patent is extended or adjusted under 35 U.S.C. 154(b) by 0 days.

(21) Appl. No.: 10/217,902

(22) Filed: Aug. 13, 2002

(65) Prior Publication Data

US 2003/0141048 A1 Jul. 31, 2003

(30) Foreign Application Priority Data

Jan. 31, 2002 (KR) ..... 2002-5595

(51) Int. Cl.[7] ..... F28F 9/02
(52) U.S. Cl. ..... 165/174; 165/177; 165/140
(58) Field of Search ..... 167/174, 176, 167/177, 178, 179, 183, 109.1, 140; 138/38, 115, 116; 29/890.053, 890.045

(56) References Cited

U.S. PATENT DOCUMENTS 4,512,069 A * 4/1985 Hagemeister ..... 29/889.721
5,476,141 A * 12/1995 Tanaka ..... 165/173
5,904,206 A * 5/1999 Kroetsch ..... 165/173
6,000,467 A * 12/1999 Tokizaki et al. ..... 165/134.1
6,216,776 B1 * 4/2001 Kobayashi et al. ..... 165/173
6,289,981 B1 * 9/2001 Tokizaki et al. ..... 165/177
6,340,055 B1 * 1/2002 Yamauchi et al. ..... 165/174

FOREIGN PATENT DOCUMENTS

| | | |
|---|---|---|
| EP | 0990828 A3 | 4/2000 |
| JP | 11159985 | 6/1999 |
| JP | 2000018867 | 1/2000 |
| JP | 2000356488 | 12/2000 |

* cited by examiner

*Primary Examiner*—Tho V Duong
(74) *Attorney, Agent, or Firm*—Fulbright & Jaworski L.L.P.

(57) ABSTRACT

A heat exchanger tube and a heat exchanger that uses the heat exchanger tube. The heat exchanger tube is provided with a generally flat body has a plurality of refrigerant passages that pass through the interior of the flat body in the length direction thereof. The tube includes refrigerant passages which are provided with a plurality of inside passages, each of which has a first curved portion that is made by changing a predetermined curve over at least a time or more to form a curve changing point protruding in the width direction of the body. A second curved portion is formed opposite to the first curved portion and is connected slowly to the first curved portion to thereby form a curve closed face. A pair of outside passages is disposed on the outermost both ends of the plurality of inside passages.

52 Claims, 11 Drawing Sheets

Prior Art

HEAT EXCHANGER TUBE AND HEAT EXCHANGER USING THE SAME

TECHNICAL FIELD

The present invention relates to a heat exchanger tube and a heat exchanger using the heat exchanger tube.

BACKGROUND ART

Generally, an air conditioning device for a vehicle includes a heat exchanger that is provided with a condenser exchanging refrigerant being at high temperature and pressure delivered from a compressor with an external air to thereby make the heat-exchanged refrigerant liquefied, and with an evaporator that enables the liquefied refrigerant to be varied into air being at a low temperature such that the air around the low temperature air becomes cool.

Each of the condenser and evaporator includes a plurality of tubes, each of which has a plurality of refrigerant passages through which the refrigerant is passed, a plurality of corrugated fins placed between the tubes in a form of wave, a pair of header tanks that connect the both ends of each of the tubes in such a manner as to communicate with the tubes, and inlet and outlet pipes disposed in each of the header tanks, to and from which the refrigerant flows.

At that time, the condenser of the heat exchanger as mentioned above is provided with the plurality of flat-shaped tubes, each of which has a multipassage formed therein. This is disclosed in Japanese Patent Publication No. 11-159985.

As shown in FIGS. 1 and 2, the above-mentioned conventional heat exchanger is provided with a plurality of heat exchanger tubes 11, each of which forms a plurality of refrigerant passages 15 or 21 therein, wherein the refrigerant passages 15 or 21 with a polygonal or circular section are connected with each other, disposed in the same direction.

The above-discussed conventional heat exchanger has had the following problems.

So as to improve the performance of the heat exchanger, typically, it is important to increase a heat transfer area where the refrigerant is heat-exchanged. To do this, there has been provided a method in which a hydraulic diameter is reduced.

Referring to the above-mentioned conventional heat exchanger as shown in FIGS. 1 and 2, the plurality of refrigerant passages 15 or 21 are disposed in the width direction of the heat exchanger tube 11, and if the ratio of the width w of each of the refrigerant passages 15 or 21 to the height h is set higher than 1 (that is, $w/h>1$), a wall thickness t becomes increase as the hydraulic diameter is set relatively low in the heat exchanger provided with the heat exchanger tube 11 having the same size.

As the wall thickness t increases, however, the weight of the heat exchanger tube 11 increases as well as the production cost is raised due to the unnecessary consumption of the material.

On the other hand, FIG. 3 shows another conventional heat exchanger, which is disclosed in Japanese Patent Publication No. 2000-111290.

As shown in FIG. 3, the above-mentioned conventional heat exchanger is provided with a multipassage type of flat tube 5 in which a plurality of generally oval refrigerant passages 2*a* that are spaced apart equally, inclined by a predetermined angle $\alpha$ against the direction of an axis y.

The conventional heat exchanger as mentioned above has failed to improve the heat transfer efficiency thereof.

If an extruding speed increases by a predetermined value more than during the extruding process of the tube manufacturing, in addition, the above-mentioned conventional type of the heat exchangers undesirably form a pin hole on the external side of each of the tubes such that the pin hole is not filled even in the brazing process thereof, which results in the increment of the generation of the defective heat exchanger.

To produce a good quality of heat exchanger, therefore, the tube should be manufactured only at the predetermined extruding speed, which of course will cause the productivity thereof to be undesirably low.

DISCLOSURE OF INVENTION

Accordingly, the present invention is directed to a heat exchanger tube and a heat exchanger using the heat exchanger tube that substantially obviates one or more problems due to limitations and disadvantages of the related art.

An object of the present invention is to provide a heat exchanger tube and a heat exchanger using the heat exchanger tube that can maintain a tube thickness at a predetermined value, even when a hydraulic diameter is set low such that a heat transfer area increases so as to improve the performance of a heat exchanger, thereby allowing the weight of the tube and the production cost thereof to be reduced, that can evenly distribute the stress caused by the operating pressure of a heat exchanging medium onto a plurality of refrigerant passages, not gathered partially on the refrigerant passages, such that a resistant pressure strength is substantially enough, thereby allowing the heat exchanging medium to be substantially replaced with carbon dioxide, that can make, in case where the tube is applied in a condenser, the film of a condensed liquid substantially thin in thickness by means of turbulence activating parts that face with each other in each of the refrigerant passages, thereby allowing a heat transfer efficiency to be enhanced, and that can make the refrigerant passing through the refrigerant passages activated to form the turbulence thereof since the turbulence activating parts face with each other in the width direction thereof, thereby allowing the heat transfer performance thereof to be improved.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

According to an aspect of the present invention, there is provided a heat exchanger tube that has a generally flat body having predetermined values in length, height and width directions, the plurality of refrigerant passages formed passed through the interior of the flat body in the length direction thereof, the heat exchanger tube including: each of the plurality of refrigerant passages is provided with a plurality of inside passages, each of which has a first curved portion that is made by changing a predetermined curve over at least a time or more to form a curve changing point protruding in the width direction of the body by which turbulence activating parts are formed, and has a second curved portion that is formed opposite to the first curved portion and is connected slowly to the first curved portion to thereby form a curve closed face, and with a pair of outside passages disposed on the outermost both ends of the plurality of inside passages.

According to another aspect of the present invention, there is provided a heat exchanger including: a plurality of tubes, each of which is comprised of a plurality of inside passages, each of which has a first curved portion that is made by changing a predetermined curve over at least a time or more to form a curve changing point protruding in the width direction of a body, by which turbulence activating parts are formed, and has a second curved portion that is formed opposite to the first curved portion and is connected slowly to the first curved portion to thereby form a curve closed face, and a pair of outside passages disposed on the outermost both ends of the plurality of inside passages, the plurality of tubes spaced apart equally through each of which a heat exchanging medium flows; and a pair of header tanks that are spaced apart equally in parallel relation with each other such that the both ends of each of the tubes communicate with each other, through which the heat exchanging medium flows.

BEST MODE FOR CARRYING OUT THE INVENTION

Reference will now be made in detail to the preferred embodiments of the present invention, examples of which are illustrated in the accompanying drawings.

First, an explanation of the condenser of a heat exchanger to which the principles of the present invention are applied will be given before the configuration of a heat exchanger tube according to the present invention is discussed.

Figure 1:
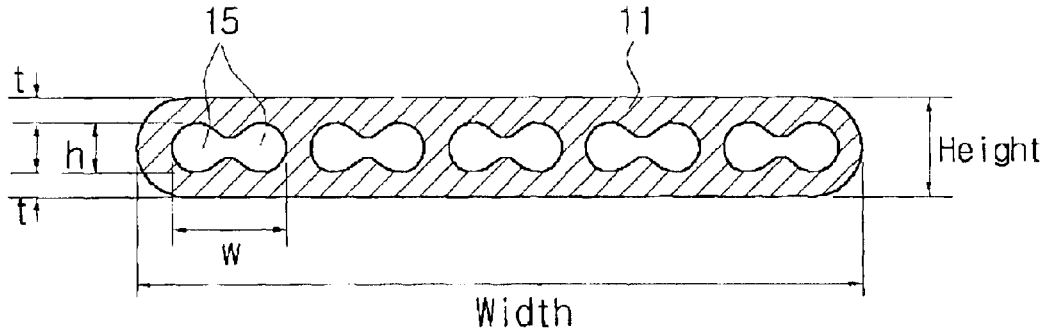
FIG. 1 is a sectional view of the prior art heat exchanger tube.
Figure 2:
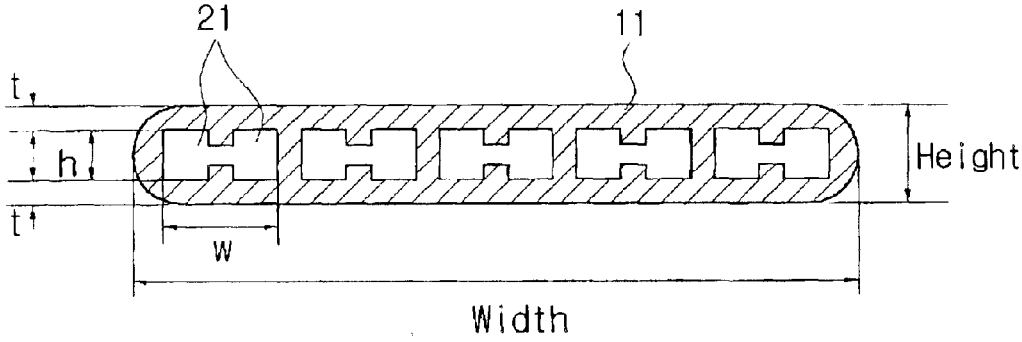
Prior Art Figure 2
FIG. 2 is a sectional view of another type of the prior art heat exchanger tube.
Figure 3:
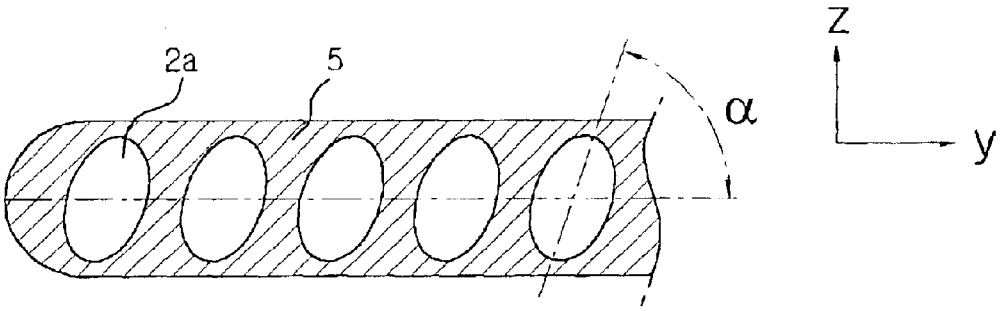
Prior Art Figure 3
FIG. 3 is a sectional view of still another type of the prior art heat exchanger tube.
Figure 4:
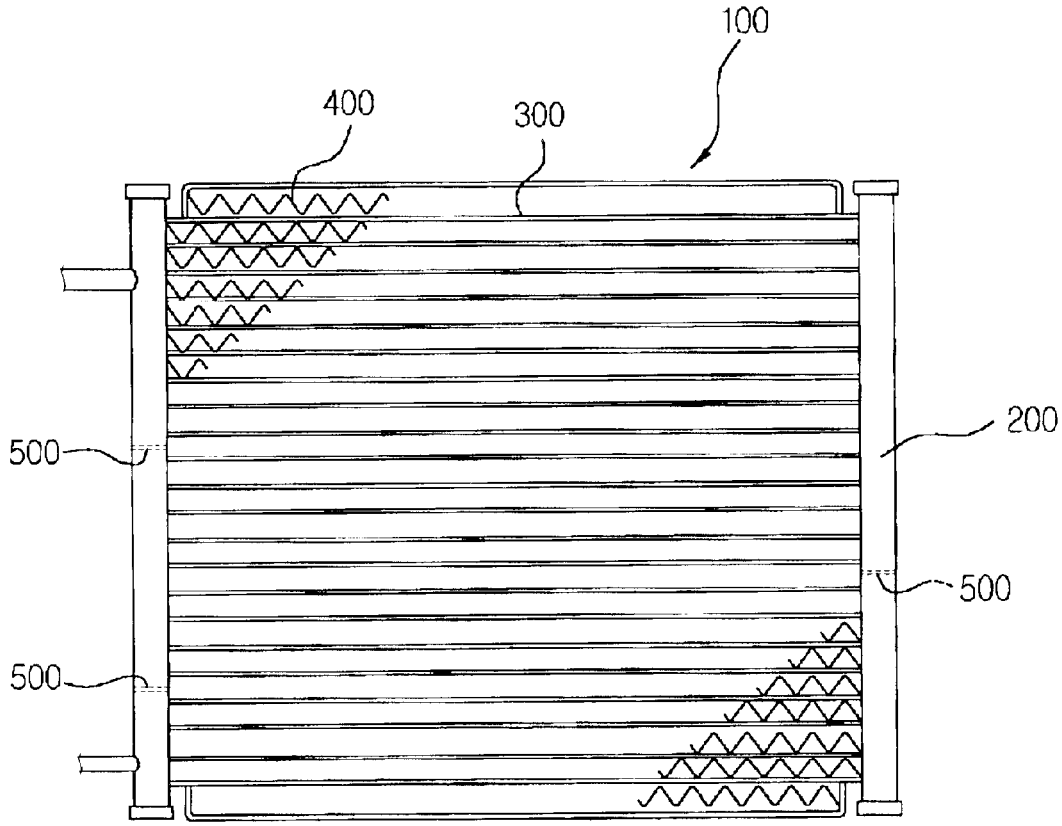
FIG. 4 is a top view of the condenser of a heat exchanger to which a heat exchanger tube according to one embodiment of the present invention is applied.

The condenser 100 includes, as shown in FIG. 4, a pair of header tanks 200, each of which has a passage through which a heat exchanging medium is passed therein, a plurality of tubes 300 through each of which the heat exchanging medium flows, and a plurality of corrugated fins 400 placed between the tubes 300.

The both ends of each of the plurality of tubes 300 are connected to the header tanks 200, and each of the header tanks 200 includes at least one or more baffles 500 therein such that it forms a plurality of passages by the plurality of tubes 300.

Figure 5:
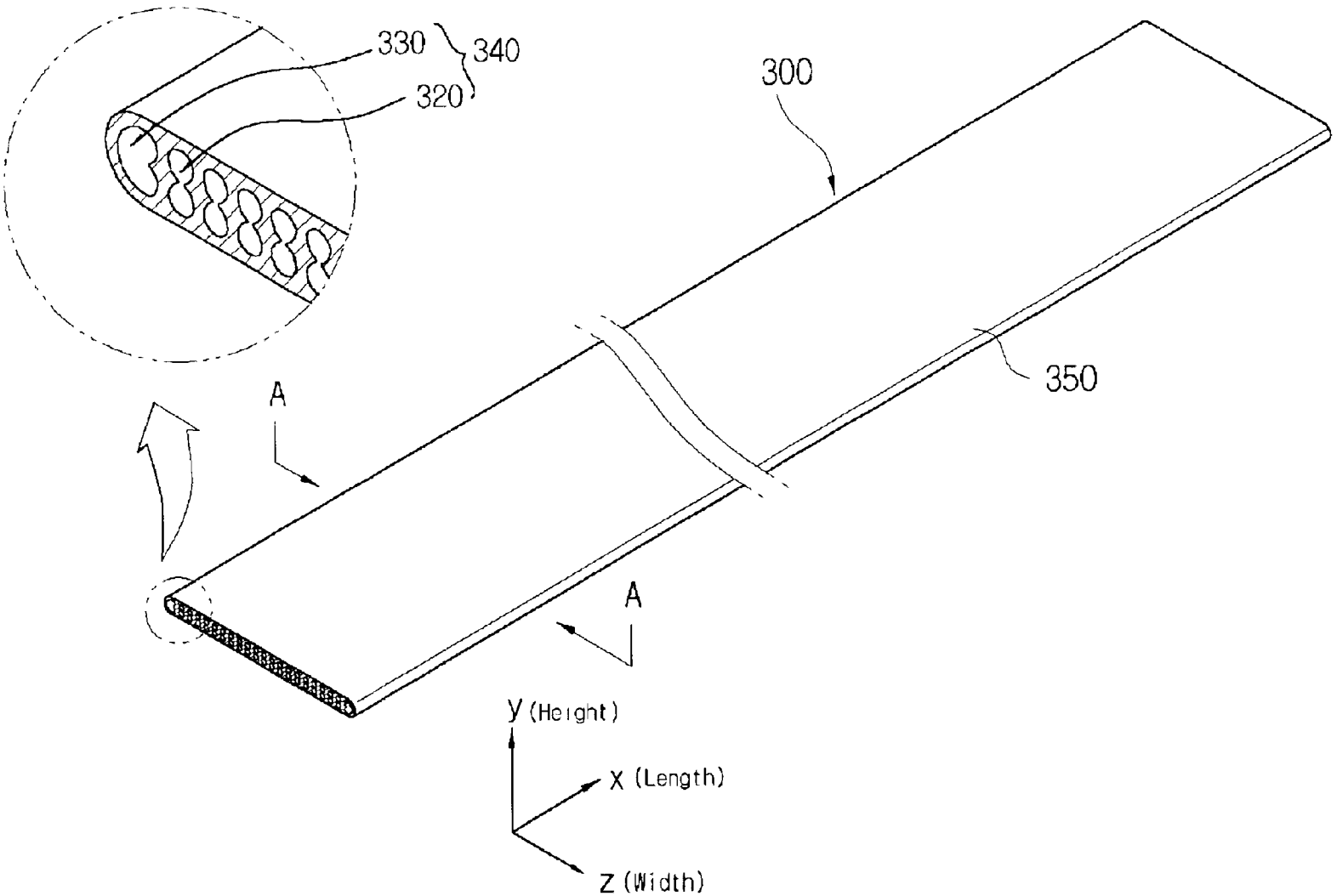
FIG. 5 is a perspective view of the external appearance of the heat exchanger tube according to the one embodiment of the present invention.

The present invention is directed to the plurality of tubes 300, each of which includes a generally flat body 350, as shown in FIG. 5, that has predetermined values in length (an axis X), height (an axis Y) and width (an axis Z) directions thereof.

The body 350 is provided with a plurality of refrigerant passages 340, each of which is passed through the interior thereof in the length direction thereof (along the axis X).

Each of the refrigerant passages 340 includes a plurality of inside passages 320 and a pair of outside passages 330 provided on the outermost both ends of the body 350.

Figure 6:
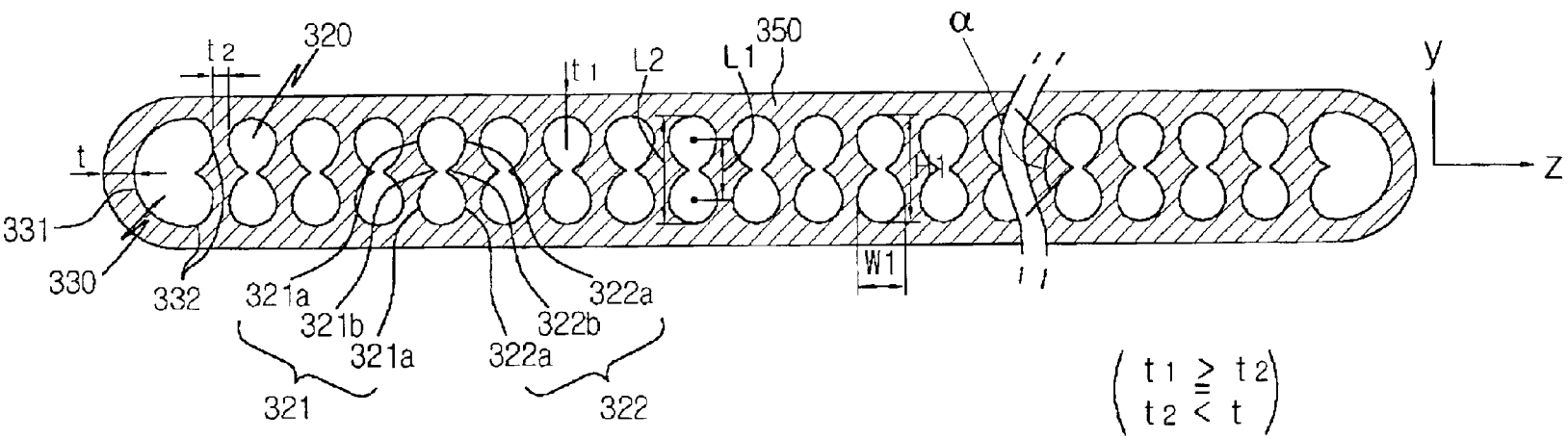
FIG. 6 is a sectional view taken along the line "A—A" in FIG. 4.
Figure 7:
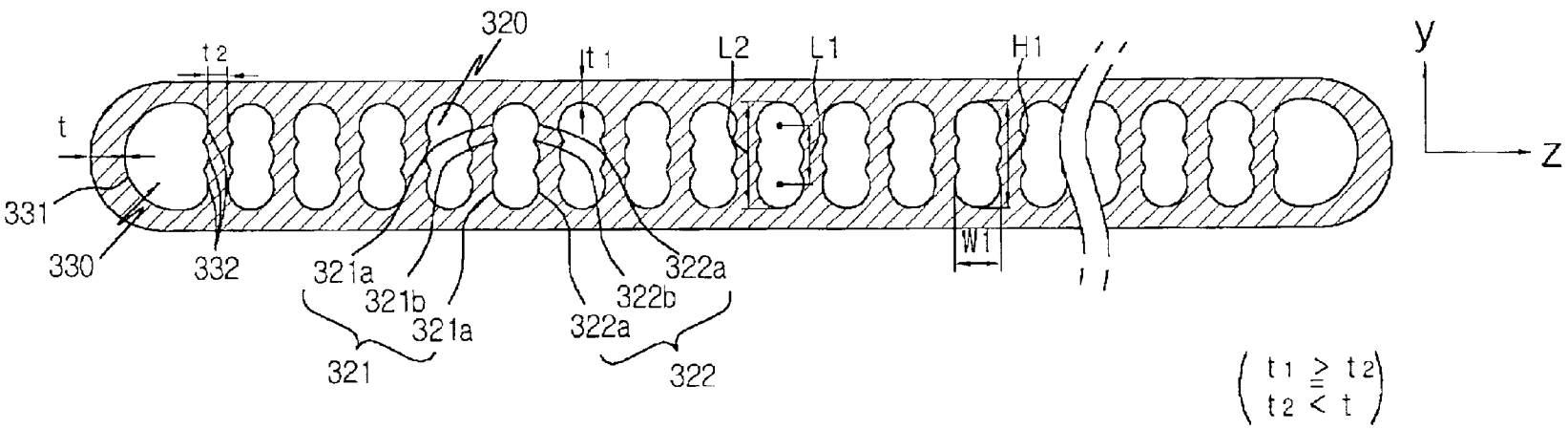
FIG. 7 is a sectional view of a heat exchanger tube according to another embodiment of the present invention wherein two turbulence activating parts are provided each curved portion.

As shown in FIGS. 6 and 7, each of the inside passages 320 has a first curved portion 321 that is made by changing a predetermined curve 321*a* over at least a time or more to form a curve changing point protruding in the width direction of the body 350, thereby forming a turbulence activating part 321*b* thereon, and a second curved portion 322 that is formed opposite to the first curved portion 321 in the width direction thereof and is connected slowly to the first curved portion 321 to thereby form a curve closed face.

In the same manner as the first curved portion 321, the second curved portion 322 is made by changing a predetermined curve 322*a* over at least a time or more to form a curve changing point protruding in the width direction of the body 350, thereby forming a turbulence activating part 322*b* thereon.

Figure 12:
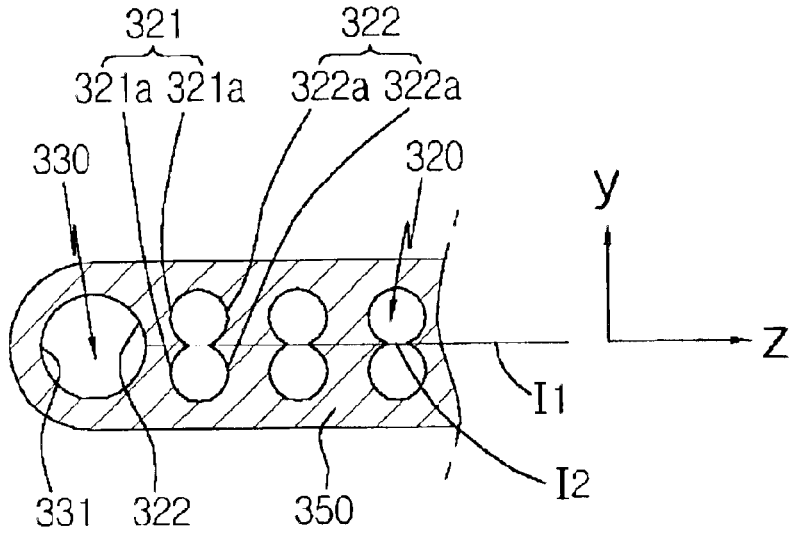

As shown in FIG. 12, each of the curves 321*a* and 322*a* constituting the first and second curved portions 321 and 322 is formed in the same curvature as a circle.

Figure 8:
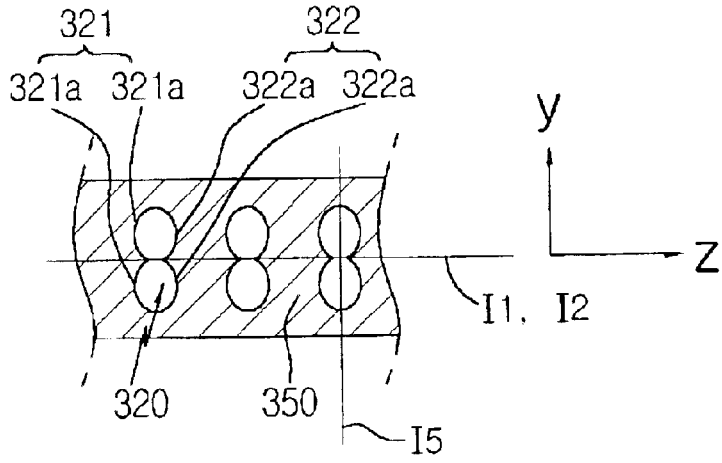
FIGS. 8 to 14 are partly sectional views of the heat exchanger tube according to another embodiment of the present invention.
Figure 9:
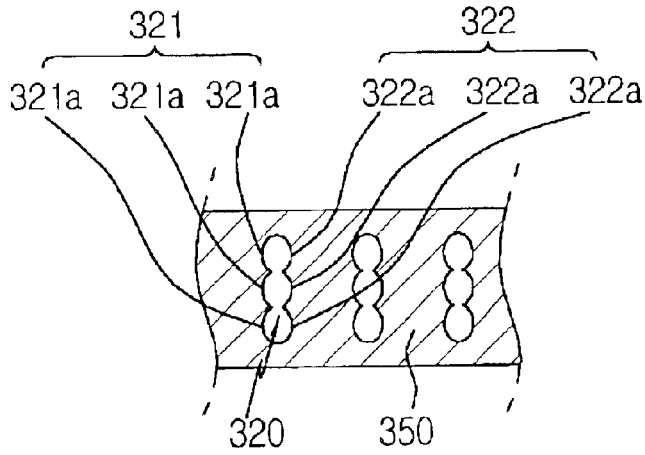

In another preferred embodiment of the present invention, each of the curves 321*a* and 322*a* constituting the first and second curved portions 321 and 322 is formed in the same curvature as an oval, as shown in FIGS. 8 and 9.

Figure 10:
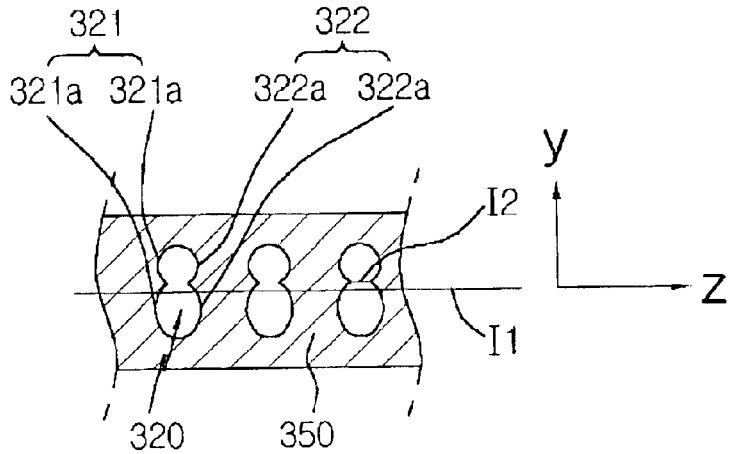
Figure 11:
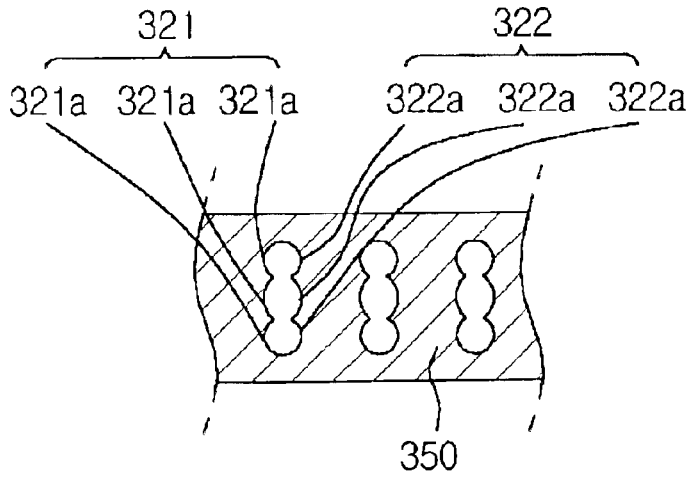

In still another preferred embodiment of the present invention, the curves 321*a* and 322*a* constituting the first and second curved portions 321 and 322 are connected in such a fashion that the curve having the curvature of the circle and the curve having the curvature of the oval are arranged in an arbitrary order, as shown in FIGS. 10 and 11.

The inside passages 320 are formed in the height direction (along the axis y) of the body 350, on condition that the ratio of the width W1 to the height H1 is less than 1 (that is, $W1/H1<1$).

Under the above-mentioned condition, the wall thickness can be maintained at a predetermined value even when a hydraulic diameter is set small so as to increase the heat transfer area for improving the performance of the heat exchanger.

That is to say, the problem as arisen conventionally that the wall thickness increases as the hydraulic diameter is set small which causes the weight of the heat exchanger tubes 11 to undesirably increase and causes the consumption of the material to be made, thereby rendering the production cost become high, can be fundamentally eliminated.

On the other hand, the pair of outside passages 330 are disposed on the outermost both ends of the inside passages 320, each of which includes a third curved portion 331 that is formed in such a manner that a part of the curve close to the outermost end of the body 350 has a roughly same shape as the section of the both ends of the body 350, and a fourth curved portion 332 that is formed by connecting the both end points of the third curved portion 331 to thereby form a closed curved face.

In this case, the fourth curved portion 332 is formed in the same shape as any of the first and second curved portions 321 and 322 of each of the inside passages 320, as shown in FIGS. 6 and 7.

And, as shown in FIG. 12, the third curved portion 331 and the fourth curved portion 332 are disposed in symmetrical relation with each other and the fourth curved portion 332 is of a desirable circular arc shape.

Figure 13:
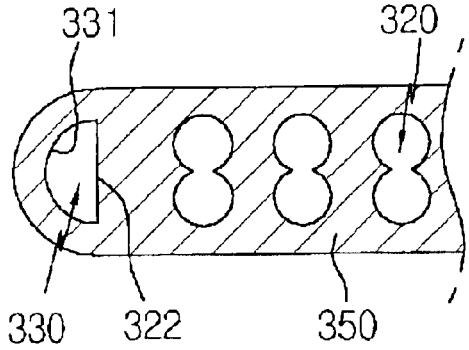

The fourth curved portion 332 is of a generally straight line shape, as shown in FIG. 13.

On the other hand, as shown in FIGS. 8 and 12, the turbulence activating parts 321*b* and 322*b* are formed in such a manner that a plurality of imaginary lines I2 connecting the turbulence activating parts 321*b* and 322*b* of the plurality of inside passages 320 correspond to an imaginary line I1 dividing said body 350 into two equal parts in the height direction of the body 350.

Figure 14:
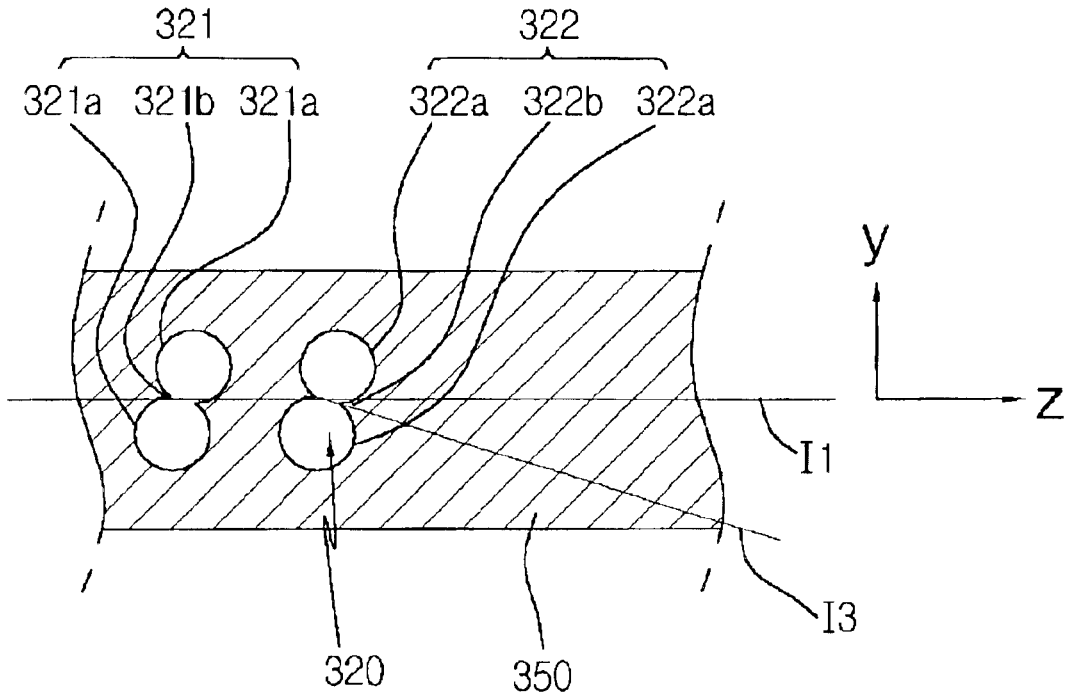
Figure 15:
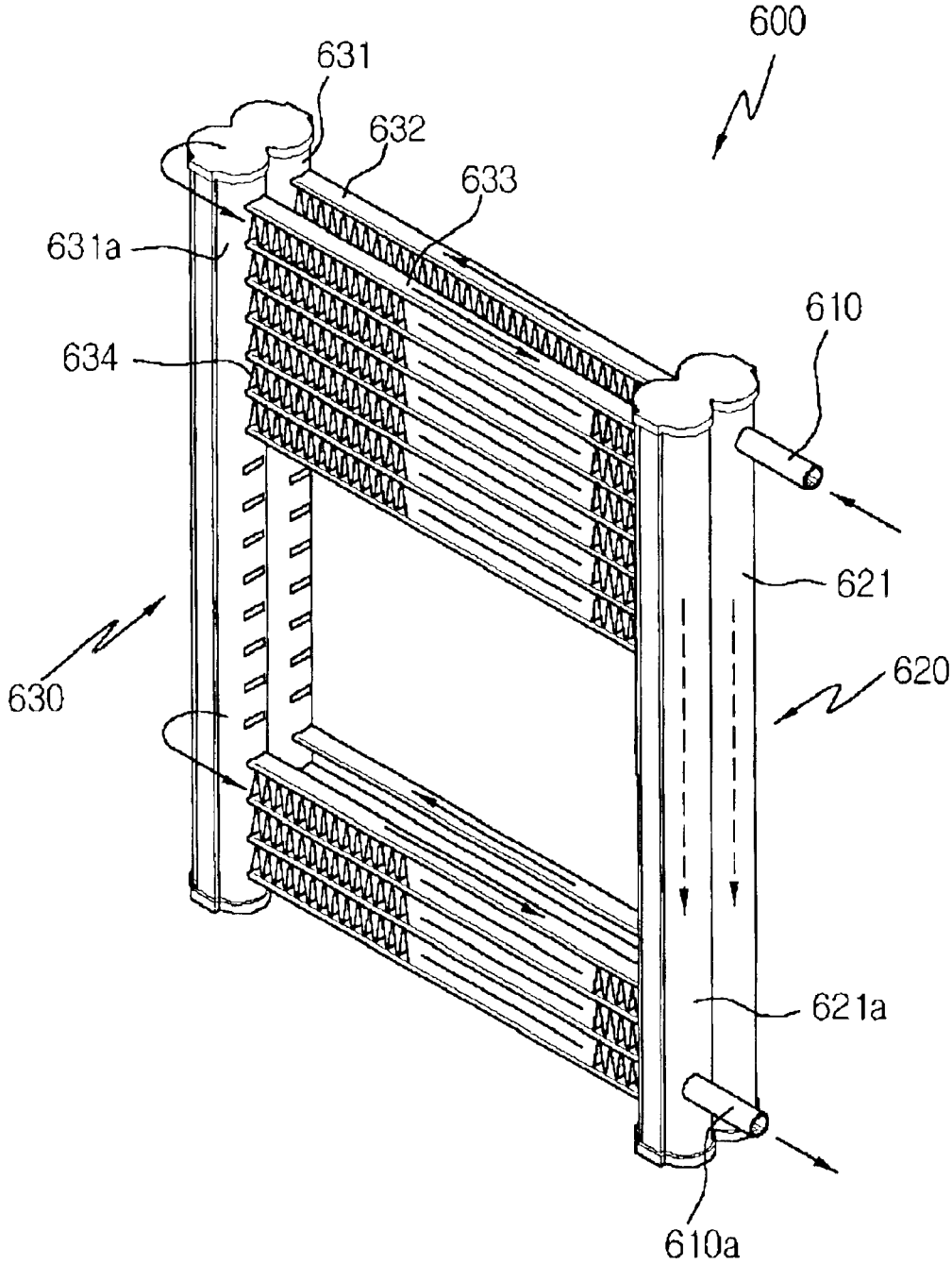
FIG. 15 is a perspective view of the external appearance of the heat exchanger to which the heat exchanger tube according to the present invention is applied, wherein a heat exchanging medium is used with carbon dioxide.

And, as shown in FIG. 14, the turbulence activating parts 321*b* and 322*b* are formed in such a manner that a plurality of imaginary lines I3 connecting the turbulence activating parts 321*b* and 322*b* of the plurality of inside passages 320 are alternated at a predetermined angle with the imaginary line I1 dividing said body 350 into two equal parts in the height direction of the body 350.

And, as shown in FIG. 10, the turbulence activating parts 321*b* and 322*b* are formed in such a manner that a plurality of imaginary lines I2 connecting the turbulence activating parts 321*b* and 322*b* of the plurality of inside passages 320 are disposed upwardly and downwardly around the imaginary line I1 dividing said body 350 into two equal parts in the height direction of the body 350.

Since the turbulence activating parts 321*b* and 322*b* are formed, the refrigerant that is passed through the inside passages 320 are activated to be turbulent, thereby improving heat transfer performance.

On the other hand, the hydraulic diameter Dh of each of the inside and outside passages 320 and 330 is equal to or larger than 0.55 mm, and smaller than or equal to 1.55 mm, which is set to satisfy the condition that $0.55\ \text{mm} \leqq Dh \leqq 1.55\ \text{mm}$.

Even when the above-mentioned hydraulic diameter is set, the shortest thickness t1 in the height direction of the body 350 of the thickness from the inner surface of each of the inside passages 320 to the outer surface of the body 350 can be maintained constantly without any increment.

As shown in FIGS. 6 and 7, a value that is obtained by dividing the length L1 of the definite straight line, which connects the center points of the two curves adjacent among the curves 321*a* constituting the first curved portion 321, into a length L2 of the longest distance between the two curves is equal to or larger than 0.3, and smaller than or equal to 0.8, which is set to satisfy the condition that $0.3 \leqq L1/L2 \leqq 0.8$.

The reason why the above condition is satisfied is that if the longest distance value L2 is over a predetermined value, the protruding height of each of the turbulence activating parts 321*b* and 322*b* becomes high such that it is difficult to manufacture the extruding mold thereof and they are liable to be easily damaged structurally.

To the contrary, if the longest distance value L2 is under the predetermined value, the protruding height of each of the turbulence activating parts 321*b* and 322*b* becomes remarkably low such that the heat exchanging performance can be degraded.

As shown in FIG. 6, the angle $\alpha$ that comes into contact with the curve at the apex of each of the turbulence activating parts 321*b* and 322*b* is larger than 80° and smaller than 160°, which is set to satisfy the condition that $80° < \alpha < 160°$.

In the above embodiment of the present invention, the shortest thickness t in the width direction of the body 350 among the thickness from the inner surface of each of the outside passages 330 to the outer surface of the body 350 should be set larger by 1.25 times than the shortest thickness t1 in the height direction of the body 350 among the thickness from the inner surface of each of the inside passages 320 to the outer surface of the body 350, which is set to satisfy the condition that $t \geqq 1.25t1$.

As shown in FIG. 8, on the other hand, the plurality of imaginary lines I2 connecting the turbulence activating parts 321*b* and 322*b* of each of the inside passages 320 are placed perpendicularly to an imaginary line I5 in the height direction of the body 350.

In the above embodiment of the present invention, a shortest thickness t2 in the width direction of the body 350 among the thickness in the width direction between the inside passages 320 should be equal to or larger than 0.15 mm and equal to or smaller than 0.35 mm, which is set to satisfy the condition that $0.15\ \text{mm} \leqq t2 \leqq 0.35\ \text{mm}$.

On the other hand, the shortest thickness t2 in the width direction of the body 350 of the thickness in the width direction between the inside passages 320 should be equal to or smaller than the shortest thickness t in the width direction of the body 350 of the thickness from the inner surface of each of the outside passages 330 to the outer surface of the body 350, which is set to satisfy the condition that $t2 \leqq t$.

And, the shortest thickness t2 in the width direction of the body 350 of the thickness in the width direction between the inside passages 320 should be equal to or smaller than the shortest thickness t1 in the height direction of the body 350 of the thickness from the inner surface of each of the inside passages 320 to the outer surface of the body 350, which is set to satisfy the condition that $t2 \leqq t1$.

If the above-mentioned conditions are satisfied, even when the extruding speed increases during the extruding process of the tube manufacturing work there is no the pin hole on the outer side of each of the tubes.

Since no pin hole is formed, therefore, the extruding speed can increase to thereby improve the productivity thereof.

The preferred embodiments of the heat exchanger tube and the heat exchanger using the heat exchanger tube have been described until now.

On the other hand, a Freon refrigerant has been mainly used as a heat exchanging medium that flows within the above-mentioned heat exchanger tube 300. However, the Freon refrigerant is treated as one of causes that make the earth warm, so that the control for use of it becomes gradually strengthened. Under the above situation, many studies for replacing the Freon refrigerant with a carbon dioxide refrigerant as most worth noticing at next generation have been made all over the world.

The carbon dioxide has some advantages that the operating compression ratio is low such that the volume efficiency is excellent and the heat transfer characteristic is extremely excellent such that the difference between the temperature on the inlet to which air as a secondary fluid flows and the temperature on the outlet from which refrigerant flows is relatively small when compared with the existing refrigerant. This exhibits many advantages as the refrigerant as well as exhibits a high degree of applicability to a heat pump.

As described above, an explanation of the heat exchanger using the carbon dioxide 600 as a heat exchanging medium will be discussed on the basis of the flowing process of the refrigerant with reference to FIG. 16.

Figure 16:
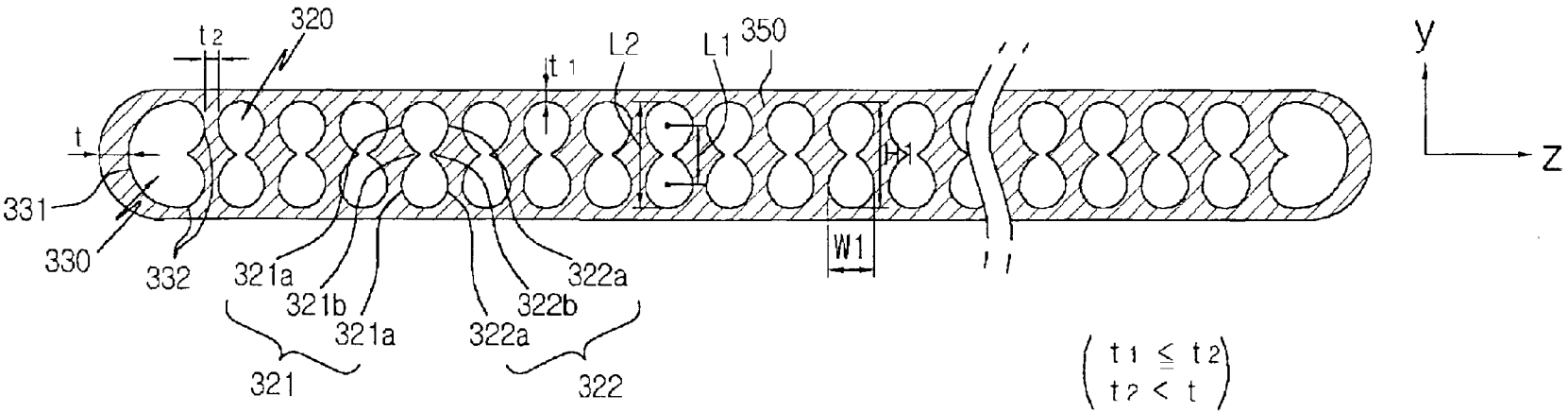
FIGS. 16 and 17 are sectional views of the embodiments of the heat exchanger tube in FIG. 15.

As shown in FIG. 16, first, the carbon dioxide flowing through an inlet 610 is moved to an internal passage 631 of a second header tank 630 from an internal passage 621 of a first header tank 620 and from a first tube 632 that is inserted into the slots (now shown) on the header tanks in such a manner as to be connected to the internal passage 631 of the second header tank 630.

In the process where the carbon dioxide refrigerant flows to the internal passage 631 of the second header tank 630, it is thermally exchanged with the external air through the first tube 632 and corrugated fins 634. On the other hand, the carbon dioxide refrigerant flowing into internal passage 631 of the second header tank 630 is returned to an internal passage 631*a* of the second header tank 630 adjacent thereto through a return hole (which is omitted in the drawing). Next, the carbon dioxide refrigerant is returned again to an internal passage 621*a* of the first header tank 620 from the internal passage 631*a* of the second header tank 630 and from a second tube 633 that is inserted into the slots (not shown) on the header tanks in such a manner as to be connected to the internal passage 621*a* of the first header tank 620.

In the process where the carbon dioxide refrigerant flows to the internal passage 621*a* of the first header tank 620, it is thermally exchanged again with the external air through the second tube 633 and the corrugated fins 634.

Through the above-mentioned process, the temperature on the outlet of the carbon dioxide refrigerant is substantially close to the temperature on the inlet of the external air.

On the other hand, the carbon dioxide refrigerant flowing into the internal passage 621 of the first header tank 632 is ejected to the outside through an outlet hole 610*a*.

Each of the first and second tubes 632 and 633 as the components of the heat exchanger using the carbon dioxide refrigerant 600 is, as shown in FIGS. 4 to 7 and FIGS. 16 and 17, comprised of the generally flat body 350 that has predetermined values in length (an axis X), height (an axis Y) and width (an axis Z) directions. The refrigerant passage 340 is formed passed through the interior of the flat body 350 in the length (the axis X) direction thereof.

The refrigerant passage 340 is provided with the plurality of inside passages 320, each of which has the first curved portion 321 that is made by changing the predetermined curve 321*a* over at least a time or more to form the curve changing point protruding in the width direction of the body 350, by which the turbulence activating part 321*b* is formed, and the second curved portion 322 that is formed opposite to the first curved portion 321 in the width direction thereof and is connected slowly to the first curved portion 321 to thereby form the curve closed face.

In the same manner as the first curved portion 321, the second curved portion 322 is made by changing the predetermined curve 322*a* over at least a time or more to form the curve changing point protruding in the width direction of the body 350, by which the turbulence activating part 322*b* is formed.

The preferred embodiments of the present invention as illustrated in FIGS. 7 to 14 can be of course applied to the tube embodied in the heat exchanger using the carbon dioxide as the heat exchanging medium.

By adopting the heat exchanger tube according to the present invention, a stress caused by the pressure of the carbon dioxide refrigerant, more specifically, a stensile stress can be prevented from focusing on a certain part of the refrigerant passage 340.

In addition, the resistant pressure strength is enough such that the carbon dioxide refrigerant can be substantially used as the heat exchanging medium.

Figure 17:
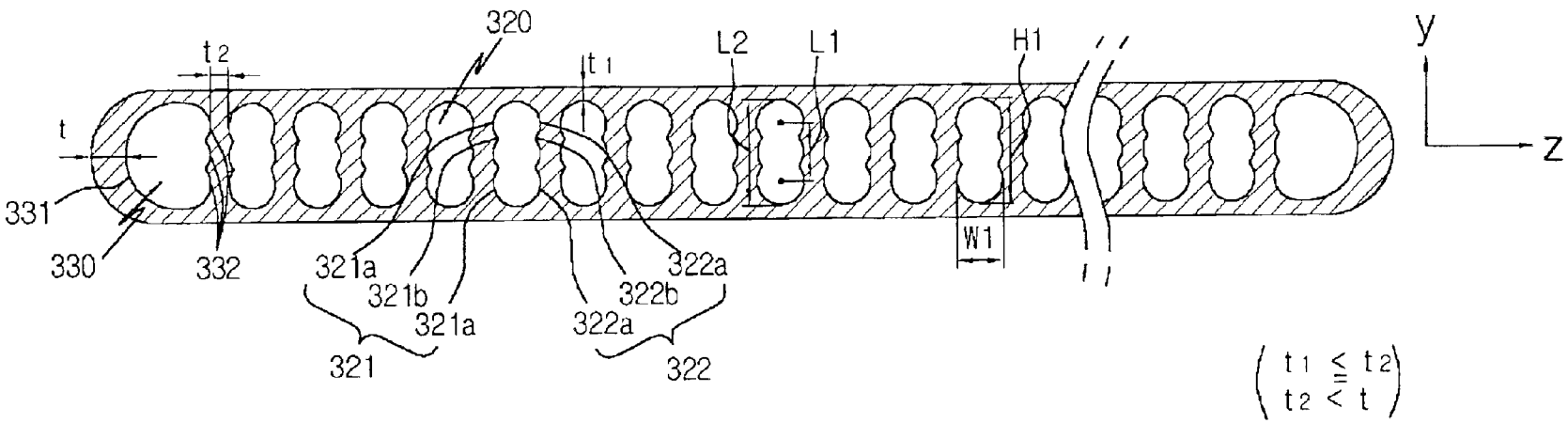

Moreover, as shown in FIGS. 16 and 17, the shortest thickness t2 in the width direction of the body 350 of the thickness in the width direction between the inside passages 320 should be equal to or larger than the shortest thickness t1 in the height direction of the body 350 of the thickness from the inner surface of each of the inside passages 320 to the outer surface of the body 350, which is set to satisfy the condition that $t2 \geqq t1$.

High pressure and durability tests are carried out for the tube manufactured under the above condition, and as a result, the shortest thickness t2 part in the width direction of the body 350 of the thickness in the width direction between the inside passages 320 is first broken off such that the inside passages 320 respectively function as a single passage. That is to say, the tube is deformed to a substantially cylindrical shape and after that, the shortest thickness t1 part in the height direction of the body 350 of the thickness from the inner surface of each of the inside passages 320 to the outer surface of the body 350 is broken off.

If the tube that satisfies the above condition $t2 \geqq t1$ is manufactured, it can be applied to the heat exchanger using the carbon oxide as replaceable refrigerant.

INDUSTRIAL APPLICABILITY

As clearly understood from the foregoing, the heat exchanger tube according to the present invention has the following advantages.

First, the stress caused by the operating pressure of a heat exchanging medium can be evenly distributed onto the whole refrigerant passages, not gathered partially on the refrigerant passages, such that a resistant pressure strength is enough, thereby allowing the heat exchanging medium to be substantially replaced with carbon dioxide.

Second, the tube thickness can be maintained at a predetermined value, even when a hydraulic diameter is set low such that a heat transfer area is increased so as to improve the performance of a heat exchanger, thereby allowing the weight thereof and production cost to be reduced.

Third, in case where the tube is applied in a condenser, the flux of the refrigerant can be increased by means of turbulence activating parts that face with each other in each of the refrigerant passages such that the thickness of the condensed liquid film can be substantially thin according to the acceleration of the turbulence of the refrigerant, thereby allowing a heat transfer efficiency to be enhanced.

Finally, the refrigerant passing through the refrigerant passages is allowed activated to form the turbulence thereof since the turbulence activating parts face with each other in the width direction thereof, thereby allowing the heat transfer performance thereof to be improved.

The forgoing embodiments are merely exemplary and are not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

What is claimed is:

1. A heat exchanger tube that has a generally flat body having predetermined values in length (an axis X), height (an axis Y) and width (an axis Z) directions, a plurality of refrigerant passages formed passed through the interior of said flat body in the length direction thereof, wherein said refrigerant passages are provided with a plurality of inside passages, each of which has a first curved portion that is made by changing predetermined curves over at least a time or more to form a curve changing point protruding into the passage in the width direction of said body, by which turbulence activating part are formed, and has a second curved portion that is formed opposite to said first curved portion and is connected slowly to said first curved portion so as to have a singular outwardly to the passage convex surface at one end and a singular outwardly to the passage concave surface at the other end of each passage in the height direction of the tube to thereby form a curve closed face; and a pair of outside passages disposed on the outermost both ends of said plurality of inside passages.

2. The heat exchanger tube according to claim 1, wherein each of said outside passages comprises a third curved portion formed in such a manner that a part of the curve close to the outermost end of said body has a roughly same shape as the section of the both ends of said body, and a fourth curved portion formed by connecting the both end points of said third curved portion to thereby form a closed curved face.

3. The heat exchanger tube according to claim 2, wherein said fourth curved portion is formed in the same shape as any of said first and second curved portions of each of said inside passages.

4. The heat exchanger tube according to claim 2, wherein said third curved portion and said fourth curved portion are disposed in symmetrical relation with each other.

5. The heat exchanger tube according to claim 2, wherein said fourth curved portion is of a generally circular arc shape.

6. The heat exchanger tube according to claim 2, wherein said fourth curved portion is of a generally straight-line shape.

7. The heat exchanger tube according to claim 1, wherein each of said curves constituting said first and second curved portions are formed in the same curvature as a circle.

8. The heat exchanger tube according to claim 1, wherein each of said curves constituting said first and second curved portions are formed in the same curvature as an oval.

9. The heat exchanger tube according to claim 1, wherein said curves constituting said first and second curved portions are connected in such a fashion that said curve having the curvature of a circle and said curve having the curvature of an oval are arranged in an arbitrary order.

10. The heat exchanger tube according to claim 1, wherein said turbulence activating parts are formed in such a manner that a plurality of second imaginary lines connecting said turbulence activating parts of said plurality of inside passages correspond to a first imaginary line dividing said body into two equal parts in the height direction of the body.

11. The heat exchanger tube according to claim 1, wherein said turbulence activating parts are formed in such a manner that a plurality of third imaginary lines connecting said turbulence activating parts of said plurality of inside passages are alternated at a predetermined angle with said first imaginary line dividing said body into two equal parts in the height direction of the body.

12. The heat exchanger tube according to claim 1, wherein said turbulence activating parts are formed in such a manner that a plurality of third imaginary lines connecting said turbulence activating parts of said plurality of inside passages are disposed upwardly and downwardly around said first imaginary line dividing said body into two equal parts in the height direction of the body.

13. The heat exchanger tube according to claim 5, wherein a value that is obtained by dividing a length of the definite straight line, which connects the center points of the two curves adjacent among said curves constituting said first curved portion, into a length of the longest distance between the two curves is equal to or larger than 0.3, and smaller than or equal to 0.8, which is set to satisfy the condition $0.3 \leqq L1/L2 \leqq 0.8$.

14. The heat exchanger tube according to claim 1, wherein said inside and outside passages have hydraulic diameters those are equal to or larger than 0.55 mm, and smaller than or equal to 1.55 mm, which is set to satisfy the condition that $0.55\ \text{mm} \leqq Dh \leqq 1.55\ \text{mm}$.

15. The heat exchanger tube according to claim 1, wherein an angle $\alpha$ that comes into contact with the curve at the apex of each of said turbulence activating parts is larger than 80° and smaller than 160°, which is set to satisfy the condition that $80° < \alpha < 160°$.

16. The heat exchanger tube according to claim 15, wherein a shortest thickness in the width direction of said body of the thickness from the inner surface of each of said outside passages to the outer surface of said body is set larger by 1.25 times than the shortest thickness in the height direction of said body of the thickness from the inner surface of each of said inside passages to the outer surface of said body, which is set to satisfy the condition that $t \geqq 1.25\ t1$.

17. The heat exchanger tube according to claim 1, wherein said plurality of second imaginary lines connecting said turbulence activating parts of each of said inside passages are placed perpendicularly to said fifth imaginary line in the height direction of said body.

18. The heat exchanger tube according to claim 17, wherein a shortest thickness in the width direction of said body of the thickness in the width direction between said inside passages is equal to or larger than 0.15 mm, and equal to or smaller than 0.35 mm, which is represented by the following inequality: $0.15\ \text{mm} \leqq t2 \leqq 0.35\ \text{mm}$.

19. The heat exchanger tube according to claim 1, wherein said shortest thickness in the width direction of said body of the thickness in the width direction between said inside passages is equal to or smaller than said shortest thickness in the width direction of said body of the thickness from the inner surface of each of said outside passages to the outer surface of said body, which is set to satisfy the condition that $t2 \leqq t$.

20. The heat exchanger tube according to claim 1, wherein said shortest thickness in the width direction of said body of the thickness in the width direction between said inside passages is equal to or smaller than said shortest thickness in the height direction of said body of the thickness from the inner surface of each of said inside passages to the outer surface of said body, which is set to satisfy the condition that $t2 \leqq t1$.

21. A heat exchanger comprising:

a plurality of tubes, each of which has a generally flat body having predetermined values in length (an axis X), height (an axis Y), and width (an axis Z) directions, a plurality of refrigerant passages formed passed through the interior of said flat body in the length direction thereof, wherein said refrigerant passages are provided with a plurality of inside passages, each inside passages having a first curved portion that is made by changing predetermined curves over at least a time or more to form a curve changing point protruding into the passage said in the width direction of body, by which turbulence activating parts are formed, and having a second curved portion that is formed opposite to said first curved portion so as to have a singular outwardly convex surface to the passage at one end and a singular outwardly concave surface to the passage at the other end of each passage in the height direction of the tube and is connected slowly to said first curved portion to thereby form a curve closed face, and a pair of outside passages disposed on the outermost both ends of said plurality of inside passages, said plurality of tubes spaced apart equally through which a heat exchanging medium flows;

a plurality of corrugated fins disposed between said tubes; and a pair of header tanks spaced apart equally in parallel relation with each other such that the both ends of each of said tubes communicate with each other, through which said heat exchanging medium flows.

22. The heat exchanger according to claim 21, wherein said heat exchanging medium is carbon dioxide.

23. The heat exchanger according to claim 21, wherein each of said outside passages comprises a third curved portion formed in such a manner that a part of the curve close to the outermost end of said body has a roughly same shape as the section of the both ends of said body, and a fourth curved portion formed by connecting the both end points of said third curved portion to thereby form a closed curved face.

24. The heat exchanger according to claim 23, wherein said fourth curved portion is formed in the same shape as any of said first and second curved portions of each of said inside passages.

25. The heat exchanger according to claim 23, wherein said third curved portion and said fourth curved portion are disposed in symmetrical relation with each other.

26. The heat exchanger according to claim 23, wherein said fourth curved portion is of a generally circular arc shape.

27. The heat exchanger according to claim 23, wherein said fourth curved portion is of a generally straight-line shape.

28. The heat exchanger according to claim 21, wherein each of said curves constituting said first and second curved portions is formed in the same curvature as a circle.

29. The heat exchanger according to claim 21, wherein each of said curves constituting said first and second curved portions is formed in the same curvature as an oval.

30. The heat exchanger according to claim 21, wherein said curves constituting said first and second curved portions are connected in such a fashion that said curves having the curvature of a circle and said curves having the curvature of an oval are arranged in an arbitrary order.

31. The heat exchanger according to claim 21, wherein said turbulence activating parts are formed in such a manner that a plurality of second imaginary lines connecting said turbulence activating parts of said plurality of inside passages correspond to the first imaginary line dividing said body into two equal parts in the height direction of the body.

32. The heat exchanger according to claim 21, wherein said turbulence activating parts are formed in such a manner that a plurality of third imaginary lines connecting said turbulence activating parts of said plurality of inside passages are alternated at a predetermined angle with said first imaginary line dividing said body into two equal parts in the height direction of the body.

33. The heat exchanger according to claim 21, wherein said turbulence activating parts are formed in such a manner that a plurality of second imaginary lines connecting said turbulence activating parts of said plurality of inside passages are disposed upwardly and downwardly around said first imaginary line dividing said body into two equal parts in the height direction of the body.

34. The heat exchanger according to claim 26, wherein a value that is obtained by dividing a length of the definite straight line, which connects the center points of the two curves adjacent among said curves constituting said first curved portion, into a length of the longest distance between the two curves is equal to or larger than 0.3, and smaller than or equal to 0.8, which is set to satisfy the condition that $0.3 \leqq L1/L2 \leqq 0.8$.

35. The heat exchanger according to claim 21, wherein said inside and outside passages have hydraulic diameters those are equal to or larger than 0.55 mm, and smaller than or equal to 1.55 mm, which is set to satisfy the condition that $0.55\ \text{mm} \leqq Dh \leqq 1.55\ \text{mm}$.

36. The heat exchanger according to claim 21, wherein an angle a that comes into contact with the curve at the apex of each of said turbulence activating parts is larger than 80° and smaller than 160°, which is set to satisfy the condition that $80° \leqq \alpha \leqq 160°$.

37. The heat exchanger according to claim 36, wherein a shortest thickness in the width direction of said body of the thickness from the inner surface of each of said outside passages to the outer surface of said body is set larger by 1.25 times than the shortest thickness in the height direction of said body of the thickness from the inner surface of each of said inside passages to the outer surface of said body, which is set to satisfy the condition that $t \geqq 1.25\ t1$.

38. The heat exchanger tube according to claim 21, wherein said plurality of second imaginary lines connecting said turbulence activating parts of each of said inside passages are placed perpendicularly to said fifth imaginary line in the height direction of said body.

39. The heat exchanger tube according to claim 38, wherein a shortest thickness in the width direction of said body among the thickness in the width direction between said inside passages is equal to or larger than 0.15 mm and equal to or smaller than 0.35 mm, which is set to satisfy the condition that $0.15\ \text{mm} \leqq t2 \leqq 0.35\ \text{mm}$.

40. The heat exchanger tube according to claim 21, wherein said shortest thickness in the width direction of said body of the thickness in the width direction between said inside passages is equal to or smaller than said shortest thickness in the width direction of said body of the thickness from the inner surface of each of said outside passages to the outer surface of said body, which is set to satisfy the condition that $t2 \leqq t$.

41. The heat exchanger according to claim 22, wherein said shortest thickness in the width direction of said body of the thickness in the width direction between said inside passages is equal to or larger than said shortest thickness in the height direction of said body of the thickness from the inner surface of each of said inside passages to the outer surface of said body, which is set to satisfy the condition that $t2 \geqq t1$.

42. The heat exchanger according to claim 22, wherein each of said outside passages comprises a third curved portion formed in such a manner that a part of the curve close to the outermost end of said body has a roughly same shape as the section of the both ends of said body, and a fourth curved portion formed by connecting the both end points of said third curved portion to thereby form a closed curved face.

43. The heat exchanger according to claim 22, wherein each of said curves constituting said first and second curved portions is formed in the same curvature as a circle.

44. The heat exchanger according to claim 22, wherein each of said curves constituting said first and second curved portions is formed in the same curvature as an oval.

45. The heat exchanger according to claim 22, wherein said curves constituting said first and second curved portions are connected in such a fashion that said curves having the curvature of a circle and said curves having the curvature of an oval are arranged in an arbitrary order.

46. The heat exchanger according to claim 22, wherein said turbulence activating parts are formed in such a manner that a plurality of second imaginary lines connecting said turbulence activating parts of said plurality of inside passages correspond to the first imaginary line dividing said body into two equal parts in the height direction of the body.

47. The heat exchanger according to claim 22, wherein said turbulence activating parts are formed in such a manner that a plurality of third imaginary lines connecting said turbulence activating parts of said plurality of inside passages are alternated at a predetermined angle with said first imaginary line dividing said body into two equal parts in the height direction of the body.

48. The heat exchanger according to claim 22, wherein said turbulence activating parts are formed in such a manner that a plurality of fourth imaginary lines connecting said turbulence activating parts of said plurality of inside passages are disposed upwardly and downwardly around said first imaginary line dividing said body into two equal parts in the height direction of the body.

49. The heat exchanger according to claim 22, wherein said inside and outside passages have hydraulic diameters those are equal to or larger than 0.55 mm, and smaller than or equal to 1.55 mm, which is set to satisfy the condition that $0.55\ \text{mm} \leqq Dh \leqq 1.55\ \text{mm}$.

50. The heat exchanger according to claim 22, wherein an angle $\alpha$ that comes into contact with the curve at the apex of each of said turbulence activating parts is larger than 80° and smaller than 160°, which is set to satisfy the condition that $80° \leqq \alpha 160°$.

51. The heat exchanger tube according to claim 22, wherein said plurality of first imaginary lines connecting said turbulence activating parts of each of said inside passages are placed perpendicularly to said fifth imaginary line in the height direction of said body.

52. The heat exchanger tube according to claim 22, wherein a shortest thickness in the width direction of said body among the thickness in the width direction between said inside passages is equal to or larger than 0.15 mm and equal to or smaller than 0.35 mm, which is set to satisfy the condition that $0.15\ \text{mm} \leqq t2 \leqq 0.35\ \text{mm}$.

* * * * *